US008250985B2

(12) United States Patent
Hugus et al.

(10) Patent No.: US 8,250,985 B2
(45) Date of Patent: Aug. 28, 2012

(54) STRUCTURAL METALLIC BINDERS FOR REACTIVE FRAGMENTATION WEAPONS

(75) Inventors: George D. Hugus, Chuluota, FL (US); Edward W. Sheridan, Orlando, FL (US); George W. Brooks, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 1604 days.

(21) Appl. No.: 11/447,069

(22) Filed: Jun. 6, 2006

(65) Prior Publication Data

US 2010/0024676 A1 Feb. 4, 2010

(51) Int. Cl.
*F42B 12/22* (2006.01)

(52) U.S. Cl. ..... 102/494; 102/496; 102/473; 102/517

(58) Field of Classification Search ..... 102/431, 102/439, 473, 491–497, 501, 506, 517, 516
See application file for complete search history.

(56) References Cited

U.S. PATENT DOCUMENTS

| | | | |
|---|---|---|---|
| 1,367,846 | A | 2/1921 | Washburn |
| 1,399,953 | A | 12/1921 | Fulton |
| 2,200,742 | A | 5/1940 | Hardy |
| 2,200,743 | A | 5/1940 | Hardy |
| 3,056,255 | A | 10/1962 | Thomsen |
| 3,254,996 | A | 6/1966 | MacDonald |
| 3,261,732 | A | 7/1966 | Eilo |
| 3,325,316 | A | 6/1967 | MacDonald |
| 3,344,210 | A | 9/1967 | Silvia |
| 3,362,859 | A | 1/1968 | Sutton |
| 3,422,880 | A | 1/1969 | Brown et al. |
| 3,433,196 | A | 3/1969 | Sjoblom |
| 3,437,534 | A | 4/1969 | McEwan et al. |
| 3,596,602 | A | 8/1971 | Gey et al. |
| 3,632,458 | A | 1/1972 | Filter et al. |
| 3,661,083 | A | 5/1972 | Weimholt |
| 3,831,520 | A | 8/1974 | Bowen et al. |
| 3,961,576 | A | 6/1976 | Montgomery, Jr. |
| 4,112,847 | A | 9/1978 | Thomanek |
| 4,129,465 | A | 12/1978 | Johnson et al. |
| 4,357,873 | A | 11/1982 | Jager |
| 4,703,696 | A | 11/1987 | Böcker |
| 4,757,764 | A | 7/1988 | Thureson et al. |
| 4,933,241 | A | 6/1990 | Holt et al. |
| 4,982,667 | A | 1/1991 | Weimann |

(Continued)

FOREIGN PATENT DOCUMENTS

| | | |
|---|---|---|
| EP | 1 348 683 | 10/2003 |

(Continued)

OTHER PUBLICATIONS

Partial European Search Report dated Oct. 23, 2007.

(Continued)

*Primary Examiner* — James Bergin
(74) *Attorney, Agent, or Firm* — Buchanan Ingersoll & Rooney PC

(57) ABSTRACT

A munition is described including a reactive fragment having an energetic material dispersed in a metallic binder material. A method is also described including forming a energetic material; combining the energetic material with a metallic binder material to form a mixture; and shaping the mixture to form a reactive fragment. The munition may be in the form of a warhead, and the reactive fragment may be contained within a casing of the warhead.

17 Claims, 2 Drawing Sheets

U.S. PATENT DOCUMENTS 4,996,922 A 3/1991 Halcomb et al.
5,000,093 A 3/1991 Rozner et al.
5,090,322 A 2/1992 Allford
5,243,916 A 9/1993 Freche et al.
5,266,132 A 11/1993 Danen et al.
5,392,713 A 2/1995 Brown et al.
5,401,340 A 3/1995 Doll et al.
5,429,691 A 7/1995 Hinshaw et al.
5,439,537 A 8/1995 Hinshaw et al.
5,505,799 A 4/1996 Makowiecki
5,509,357 A 4/1996 Lawther
5,538,798 A 7/1996 Sheehan
5,544,589 A 8/1996 Held
5,547,715 A 8/1996 Barbee et al.
5,567,908 A 10/1996 Mc Cubbin et al.
5,700,974 A 12/1997 Taylor
5,717,159 A 2/1998 Dixon et al.
5,732,634 A 3/1998 Flickinger et al.
5,773,748 A 6/1998 Makowiecki et al.
5,817,970 A 10/1998 Feierlein
5,852,256 A * 12/1998 Hornig ..... 102/473
5,859,383 A 1/1999 Davison et al.
5,912,069 A 6/1999 Yializis et al.
5,936,184 A 8/1999 Majerus et al.
5,939,662 A 8/1999 Bootes et al.
5,949,016 A 9/1999 Baroody et al.
6,186,072 B1 2/2001 Hickerson, Jr. et al.
6,220,166 B1 4/2001 Cherry
6,276,276 B1 8/2001 Erickson
6,276,277 B1 8/2001 Schmacker
6,308,607 B1 10/2001 Woodall et al.
6,321,656 B1 11/2001 Johnson
6,382,105 B1 5/2002 Jones
6,443,789 B2 9/2002 Tominetti et al.
6,464,019 B1 10/2002 Werner et al.
6,467,416 B1 10/2002 Daniels et al.
6,494,140 B1 12/2002 Webster
6,520,258 B1 2/2003 Yang et al.
6,597,850 B2 7/2003 Andrieu et al.
6,615,737 B2 9/2003 Bonnel et al.
6,627,013 B2 9/2003 Carter, Jr. et al.
6,666,143 B1 12/2003 Collins
6,668,726 B2 12/2003 Lussier
6,679,960 B2 * 1/2004 Jones ..... 149/19.3
6,682,281 B1 1/2004 Larsen
6,682,817 B1 1/2004 della Porta et al.
6,713,177 B2 3/2004 George et al.
6,720,204 B2 4/2004 Sudijono et al.
6,736,942 B2 5/2004 Weihs et al.
6,843,868 B1 1/2005 Fawls et al.
6,846,372 B1 * 1/2005 Guirguis ..... 149/2
6,863,922 B2 3/2005 Ogihara et al.
6,955,732 B1 10/2005 Chan et al.
6,962,634 B2 * 11/2005 Nielson et al. ..... 149/19.3
6,991,860 B2 1/2006 Phillips et al.
7,191,709 B2 * 3/2007 Nechitailo ..... 102/518
7,231,876 B2 6/2007 Kellner
7,278,354 B1 10/2007 Langan et al.
7,282,634 B2 10/2007 Kuklinski
7,383,775 B1 * 6/2008 Mock et al. ..... 102/363
7,513,198 B2 4/2009 Zhang et al.
7,658,150 B2 2/2010 Rönn et al.
7,718,016 B2 5/2010 Johnson et al.
7,743,707 B1 6/2010 Melin et al.
7,770,521 B2 8/2010 Williams et al.
7,845,282 B2 * 12/2010 Sheridan et al. ..... 102/473
7,886,666 B2 2/2011 Williams et al.
7,886,668 B2 * 2/2011 Hugus et al. ..... 102/517
8,033,223 B2 * 10/2011 Sheridan et al. ..... 102/473
2001/0046597 A1 11/2001 Weihs et al.
2002/0069944 A1 6/2002 Weihs et al.
2003/0010246 A1 1/2003 Bonnel et al.
2003/0037693 A1 2/2003 Wendt, Jr. et al.
2003/0097953 A1 5/2003 Serizawa et al.
2003/0131749 A1 7/2003 Lussier
2003/0164289 A1 9/2003 Weihs et al.
2003/0167956 A1 9/2003 Kellner
2003/0203105 A1 10/2003 Porta et al.
2004/0060625 A1 4/2004 Barbee, Jr. et al.
2004/0101686 A1 5/2004 Porta et al.
2004/0151845 A1 8/2004 Nguyen et al.
2004/0244889 A1 12/2004 Sailor et al.
2005/0002856 A1 1/2005 Zaluska et al.
2005/0011395 A1 1/2005 Langan et al.
2005/0100756 A1 5/2005 Langan et al.
2005/0126793 A1 6/2005 McCuan et al.
2005/0142495 A1 6/2005 Van Heerden et al.
2005/0183618 A1 8/2005 Nechitailo
2005/0189050 A1 9/2005 Sheridan
2005/0199323 A1 9/2005 Nielson et al.
2005/0235862 A1 10/2005 Gousman et al.
2007/0006766 A1 1/2007 Kellner
2007/0169862 A1 7/2007 Hugus et al.
2007/0272112 A1 * 11/2007 Nielson et al. ..... 102/473
2007/0277914 A1 12/2007 Hugus et al.
2008/0035007 A1 * 2/2008 Nielson et al. ..... 102/517
2008/0092764 A1 4/2008 Renaud-Bezot et al.
2008/0202373 A1 8/2008 Hugus et al.
2009/0078146 A1 3/2009 Tepera et al.
2009/0221135 A1 9/2009 Gangopadhyay et al.
2009/0235836 A1 9/2009 Pratt et al.
2009/0255433 A1 10/2009 Wang et al.

FOREIGN PATENT DOCUMENTS

EP 1 659 359 5/2006
FR 1 585 162 A 1/1970
FR 2 867 469 A 9/2005
GB 1 507 119 4/1978
GB 2 260 317 A 4/1993
GB 2 412 116 9/2005
WO WO 02/16128 2/2002

OTHER PUBLICATIONS

Sheridan, Copending U.S. Appl. No. 10/923,865, filed Aug. 24, 2004 entitled "Energetic Material Composition".

Johnson et al., Copending U.S. Appl. No. 11/399,263, filed Apr. 7, 2006 entitled "Method of Making Multilayered, Hydrogen-Containing Thermite Structures".

Johnson et. al, Copending U.S. Appl. No. 11/399,392, filed Apr. 7, 2006 entitled "Methods of Making Multilayered, Hydrogen-Containing Intermetallic Structures".

Hugus et al., Copending U.S. Appl. No. 11/709,233, filed Feb. 22, 2007 entitled "Energetic Thin-Film Based Reactive Fragmentation Weapons".

Sheridan et al., Copending U.S. Appl. No. 11/451,313, filed Jun. 13, 2006 entitled "Enhanced Blast Explosive".

Hugus et al., Copending U.S. Appl. No. 11/649,818, filed Jan. 5, 2007 entitled "Solid Compsite Propellants and Methods of Making Propellants".

Hugus et. al, Copending U.S. Appl. No. 11/504,808, filed Aug. 16, 2006 entitled "Metal Binders for Thermobaric Weapons".

Hugus et al., Copending U.S. Appl. No. 11/447,068, filed Jun. 6, 2006 entitled "Metal Matrix Composite Energetic Structures".

Sheridan et al., Copending U.S. Appl. No. 11/806,221, filed May 30, 2007 entitled "Selectable Effect Warhead".

James Ertic McDonough, "Thermodynamic and Kinetic Studies of Ligand Binding, Oxidative Addition, and Group/Atom Transfer in Group VI Metal Complexes": Dec. 2005, pp. 108-149.

S,H, Fischer and M.C. Grubelich, "A Survey of Combustible Metals, Thermites, and Intermetallics for Pyrotechnic Applications," American Institute of Aeronautics and Astronautics, Inc. AIAA Meeting Papers on Disc, Jul. 1996, pp. 1-13.

L.Q. Shi et al., "Investigation of the Hydrogenation Properties of Zr Films Under Unclean Plasma Conditions," J. Vac. Sci. Tevhnol. A 20(6), Nov./Dec. 2002, pp. 1840-1845, American Vacuum Society.

Seman, Michael et al., "Investigation of the role of plasma conditions on the deposition rate and electrochromic performance of tungsten oxide thin films", J. Mac. Sci. Technol., A21(6), Nov./Dec. 2003, pp. 1927-1933.

J. Grant, editor, Hackh's Chemical Dictionary, third edition, McGraw-Hill Book Company, Inc., New York 1944.

R.J. Lewis, Sr., editor, Hawley's Condensed Chemical Dictionary, 12th edition, Vn Nostrand Reinhold Co., New York, 1993, excerpt, p. 1139.

H. Bennett, editor, Concise Chemical Dictionary, third enlarged edition, Chemical Publishing Company, Inc., New York, NY 1974, excerpt p. 1037.

Webster's Ninth New Collegiate Dictionary, Merriam-Webster's Inc., publishers; Springfield, Massachusetts, USA, 1990, excerpt p. 1224.

Boyd, J.M., "Thin-Film Electric Initiator. III. Application of Explosives and Performance Tests", U.S. Army Material Command, Harry Diamond Laboratories, Washington, DC 20438, Report No. -HDL_ TR-1414, (Jan. 1969), 28.

* cited by examiner

STRUCTURAL METALLIC BINDERS FOR REACTIVE FRAGMENTATION WEAPONS

FIELD OF THE DISCLOSURE

The present disclosure relates to energetic compositions for reactive fragment munitions. More specifically, the present disclosure relates to reactive fragments based, at least in part, on reactive energetic materials dispersed in a metallic matrix.

BACKGROUND

In the discussion that follows, reference is made to certain structures and/or methods. However, the following references should not be construed as an admission that these structures and/or methods constitute prior art. Applicant expressly reserves the right to demonstrate that such structures and/or methods do not qualify as prior art.

A conventional munition includes a container housing a high explosive and, optionally, fragments. Upon detonation of the high explosive, the container is torn apart forming fragments that are accelerated outwardly. In addition, to the extent that fragments are located within the container, these internal fragments are also propelled outwardly. The "kill mechanism" of the conventional fragmentation warhead is the penetration of the fragments (usually steel) into the device or target, which is kinetic energy dependent.

Reactive fragments are used to enhance the lethality of such munitions. A reactive fragment enhances the lethality of the device by transferring additional energy into the target. Upon impact with the target reactive fragments release additional chemical or thermal energy thereby enhancing damage, and potentially improving the lethality of the munition. The reactive fragment employs both kinetic energy transfer of the accelerated fragment into the target as well as the release chemical energy stored by the fragment. Moreover, the released chemical energy can be transferred to the surroundings thermally through radiant, conductive, and/or convective heat transfer. Thus, unlike purely kinetic fragments, the effects of such reactive fragments extend beyond the trajectory thereof.

Some reactive fragments employ composite materials based on a mixture of reactive metal powders and an oxidizer suspended in an organic matrix. However, certain engineering challenges are often encountered in the development of such reactive fragments. For example, a minimum requisite amount of activation energy must be transferred to the reactive fragments in order to trigger the release of chemical energy. There has been a general lack of confidence in the ignition of such reactive fragments upon impact at velocities less than about 4000 ft/s. In addition, since the above-mentioned reactive fragments are based on organic or polymeric matrix materials, which have a density less than that of most targets, i.e., steel, difficulties may arise with respect to the penetration capabilities of the fragment. Finally, the reactive fragments must possess a certain amount of structural integrity in order to survive shocks encountered upon launch of the munition. Again, due to the lower density of the polymeric matrix material, the above-mentioned reactive fragments may not possess the desired degree of structural integrity.

Thus, it would be advantageous to provide an improved reactive fragment which may address one or more of the above-mentioned concerns. Related publications include U.S. Pat. Nos. 3,961,576; 4,996,922; 5,700,974; 5,912,069; 5,936,184; 6,627,013; and 6,679,960, the entire disclosure of each of these publications is incorporated herein by reference.

SUMMARY OF THE INVENTION

According to the present invention, there is provided a munition including a reactive fragment which possesses one or more of: improved control of ballistic, thermal, structural and density characteristics.

According to the present invention, there is provided a munition comprising: a reactive fragment comprising energetic material component or components dispersed in a metallic binder material.

According to the present invention, there is provided a munition comprising: a reactive fragment comprising an energetic material component or components dispersed in a metallic binder material.

According to another aspect, there is provided a method comprising: forming a reactive energetic material; combining the reactive energetic material with a metallic binder material to form a mixture; and shaping the mixture to form a reactive fragment.

BRIEF DESCRIPTION OF THE DRAWING FIGURES

The following detailed description of preferred embodiments can be read in connection with the accompanying drawings in which like numerals designate like elements and in which.

DETAILED DESCRIPTION

Figure 1:
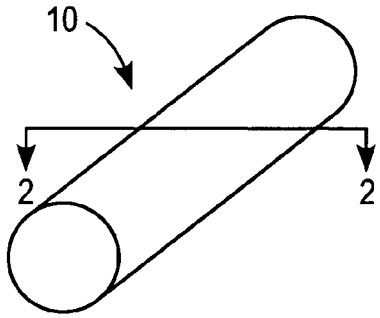
FIG. 1 is a perspective view of a reactive fragment formed according to the principles of the present invention.

One embodiment of a reactive fragment 10 formed according to the principles of the present invention is illustrated in FIG. 1. According to the illustrated embodiment, the fragment 10 has a generally cylindrical geometry. However, it should be understood that any suitable geometry is comprehended by the scope of the present invention. Thus, the fragment 10 could also be formed with a spherical, polygonal, or other suitable geometry which renders it effective for its intended purpose.

Figure 2:
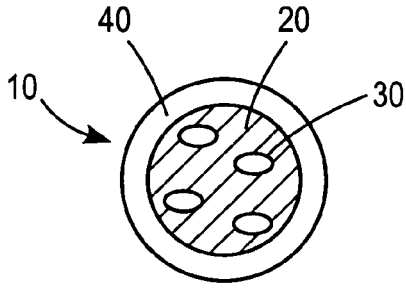
FIG. 2 is a cross-section of the reactive fragment of FIG. 1 taken along line 2-2.

As illustrated in FIG. 2, the reactive fragment 10 generally comprises a metallic binder material 20 having a reactive energetic material 30 dispersed therein. The reactive fragment 10 may optionally include a structural case or jacketing 40 which may improve the ballistic, target penetration, launch survivability of the fragment 10. Such case hardening and jacketing procedures per se are conventional in the ammunition arts.

The binder material 20 can be formed from any suitable metal or combination of metals. According to one embodiment, the binder material 20 comprises a metal or alloy that when combined with the reactive component (or components), the pressure used to compact and densify the fragment is of magnitude below that causing autoignition of the reactive materials. According to a further embodiment, the binder material 20 comprises one or more of: bismuth, lead, tin, aluminum, magnesium, titanium, gallium, indium, and alloys thereof. By way of non-limiting example, suitable binder alloys include (percentages are by mass): 52.2% In/45% Sn/1.8% Zn; 58% Bi/42% Sn; 60% Sn/40% Bi; 95% Bi/5% Sn; 55% Ge; 45% Al; 88.3% Al/11.7% Si; 92.5% Al/7.5% Si; and 95% Al/5% Si.

In addition, the binder material 20 may optionally include one or more reinforcing elements or additives. Thus, the binder material 20 may optionally include one or more of: an organic material, an inorganic material, a metastable intermolecular compound, and/or a hydride. By way of non-limiting example, one suitable additive could be a polymeric material that releases a gas upon thermal decomposition. The binder material 20 of the present invention may be provided with any suitable density. For example, the binder material 20 of the present invention may be provided with the density of at least about 7.5 g/cm$^3$. According to a further embodiment, the binder material 20 of the present invention is provided with a density of about 7.5 g/cm$^3$ to about 10.5 g/cm$^3$. Furthermore, the binder may be reinforced using organic or inorganic forms of continuous fibers, chopped fibers, a woven fibrous material, filaments, whiskers, or dispersed particulate.

Fragment 10 may contain any suitable reactive energetic material 30, which is dispersed within the metallic binder material 20. The volumetric proportion of metal binder with respect to reactive materials may be in the range of about 20 to about 80%, with the reminder of the fragment being comprised of reactive materials. The energetic material 30 may have any suitable morphology (i.e., powder, flake, crystal, etc.) or composition.

The energetic material 30 may comprise a material, or combination of materials, which upon reaction, release enthalpic or work-producing energy. One example of such a reaction is called a "thermite" reaction. Such reactions can be generally characterized as a reaction between a metal oxide and a reducing metal which upon reaction produces a metal, a different oxide, and heat. There are numerous possible metal oxide and reducing metals which can be utilized to form such reaction products. Suitable combinations include but are not limited to, mixtures of aluminum and copper oxide, aluminum and tungsten oxide, magnesium hydride and copper oxide, magnesium hydride and tungsten oxide, tantalum and copper oxide, titanium hydride and copper oxide, and thin films of aluminum and copper oxide. A generalized formula for the stoichiometry of this reaction can be represented as follows:

$$M_xO_y+M_z=M_x+M_zO_y+\text{Energy}$$

wherein $M_xO_y$ is any of several possible metal oxides, $M_z$ is any of several possible reducing metals, $M_x$ is the metal liberated from the original metal oxide, and $M_zO_y$ is a new metal oxide formed by the reaction. Thus, according to the principles of the present invention, the energetic material 30 may comprise any suitable combination of metal oxide and reducing metal which as described above produces a suitable quantity of energy spontaneously upon reaction. For purposes of illustration, suitable metal oxides include: $La_2O_3$, AgO, $ThO_2$, SrO, $ZrO_2$, $UO_2$, BaO, $CeO_2$, $B_2O_3$, $SiO_2$, $V_2O_5$, $Ta_2O_5$, NiO, $Ni_2O_3$, $Cr_2O_3$, $MoO_3$, $P_2O_5$, $SnO_2$, $WO_2$, $WO_3$, $Fe_3O_4$, $MoO_3$, NiO, CoO, $CO_3O_4$, $Sb_2O_3$, PbO, $Fe_2O_3$, $Bi_2O_3$, $MnO_2$ $Cu_2O$, and CuO. For purposes of illustration, suitable reducing metals include: Al, Zr, Th, Ca, Mg, U, B, Ce, Be, Ti, Ta, Hf, and La. The reducing metal may also be in the form of an alloy or intermetallic compound of the above. For purposes of illustration, the metal oxide is an oxide of a transition metal. According to another example, the metal oxide is a copper or tungsten oxide. According to another alternative example, the reducing metal comprises aluminum or an aluminum-containing compound.

As noted above, the energetic material components 30 may have any suitable morphology. Thus, the energetic material 30 may comprise a mixture of fine powders of one or more of the above-mentioned metal oxides and one or more of the reducing metals. This mixture of powders may be dispersed in the metal binder 20. According to certain embodiments, the metal binder 20 acts as a partial or complete source of metal fuel for the energetic, or thermite, reaction.

Figure 4:
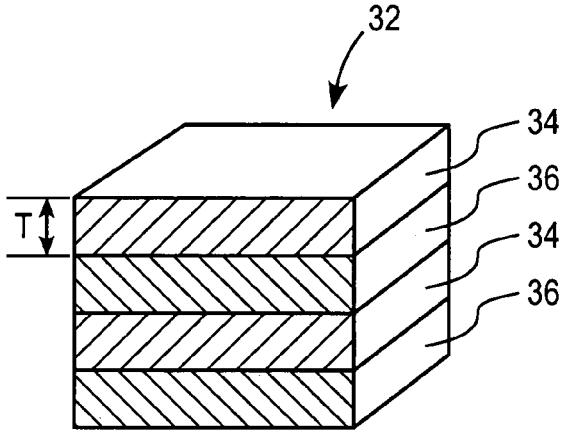
FIG. 4 is a schematic cross-section of a thin-film reactive material formed according to the principles of the present invention.

Alternatively, as schematically illustrated in FIG. 4, the energetic material 30 may be in the form of a thin film 32 having at least one layer of any of the aforementioned reducing metals 34 and at least one layer of the aforementioned metal oxides 36. The thickness T of the alternating layers can vary, and can be selected to impart desirable properties to the energetic material 30. For purposes of illustration, the thickness T of layers 34 and 36 can be about 10 to about 1000 nm. The layers 34 and 36 may be formed by any suitable technique, such as chemical or physical deposition, vacuum deposition, sputtering (e.g., magnetron sputtering), or any other suitable thin film deposition technique. Each layer of reducing metal 34 present in the thin-film can be formed from the same metal. Alternatively, the various layers of reducing metal 34 can be composed of different metals, thereby producing a multilayer structure having a plurality of different reducing metals contained therein. Similarly, each layer of metal oxide 36 can be formed from the same metal oxide. Alternatively, the various layers of metal oxide 36 can be composed of different oxides, thereby producing a multilayer structure having different metal oxides contained therein. The ability to vary the composition of the reducing metals and/or metal oxides contained in the thin-film structure advantageously increases the ability to tailor the properties of the energetic material 30, and thus the properties of the reactive fragment 10.

The reactive fragment 10 of the present invention can be formed according to any suitable method or technique.

Generally speaking, a suitable method for forming a reactive fragment includes forming an energetic material, combining the energetic material with a metallic binder material to form a mixture, and shaping the combined energetic material and metallic binder material mixture to form a reactive fragment.

The energetic material can be formed according to any suitable method or technique. For example, when the energetic material is in the form of a thin film, as mentioned above, the thin-film energetic material can be formed as follows. The alternating layers of oxide and reducing metal are deposited on a substrate using a suitable technique, such as vacuum vapor deposition or magnetron sputtering. Other techniques include mechanical rolling and ball milling to produce layered structures that are structurally similar to those produce in vacuum deposition. The deposition or fabrication processes are controlled to provide the desired layer thickness, typically on the order of about 10 to about 1000 nm. The thin-film comprising the above-mentioned alternating layers is then removed from the substrate. Removal can be accomplished by a number of suitable techniques such as photoresist coated substrate lift-off, preferential dissolution of coated substrates, and thermal shock of coating and substrate to cause film delamination. According to one embodiment, the inherent strain at the interface between the substrate and the deposited thin film is such that the thin-film will flake off the substrate with minimal or no intervention.

The removed layered material is then reduced in size; preferably, in a manner such that the pieces of thin-film having a reduced size are also substantially uniform. A number of suitable techniques can be utilized to accomplish this. For example, the pieces of thin-film removed from a substrate can be worked to pass them through a screen having a desired mesh size. By way of non-limiting example, the mesh size can be 25-60 mesh. This accomplishes both objectives of reducing the size of the pieces of thin-film removed from the substrate, and rendering the size of these pieces substantially uniform.

The above-mentioned reduced-size pieces of layered film are then combined with metallic matrix material to form a mixture. The metallic binder material can be selected from many of the above-mentioned binder materials. This combination can be accomplished by any suitable technique, such as mixing or blending. Optionally, the pieces of thin-film and/or the metallic binder material can be treated in a manner that functionalizes the surface(s) thereof, thereby promoting wetting of the pieces of thin-film in the matrix of metallic binder. Such treatments are per se known in the art. For example, the particles can be coated with a material that imparts a favorable surface energy thereto. Additives or additional components can be added to the mixture. As noted above, such additives or additional components may comprise one or more of: an organic material, an inorganic material, a metastable intermolecular compound, a hydride, and/or a reinforcing agent. Suitable reinforcing agents include fibers, filaments, dispersed particulates.

This mixture can then be shaped thereby forming a reactive fragment having a desired geometrical configuration. The fragment can be shaped by any suitable technique, such as casting, pressing, forging, cold isostatic pressing, hot isostatic pressing, etc. As noted above, the reactive fragment can be provided with any suitable geometry, such as cylindrical, spherical, polygonal, or variations thereof. Once shaped, the reactive fragment can be case hardened or jacketed in order to improve the ballistic capabilities thereof.

Figure 3:
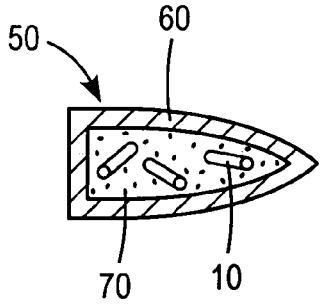
FIG. 3 is a schematic cross-section of a warhead formed according to the principles of the present invention.

There are number of potential applications for a reactive fragment formed according to principles of the present invention. As depicted in FIG. 3, one illustrative, non-limiting, application is the inclusion of reactive fragment 10 within a warhead 50. The warhead 50 generally comprises a penetrator casing 60 which houses a conventional explosive charge 70 and one or more reactive fragments 10. According to the illustrated example, a plurality of reactive fragments 10 are included. Non-limiting exemplary penetrator configurations that may benefit from inclusion of reactive fragments formed according to the present invention include a BLU-109 warhead or other munition such as BLU-109/B, BLU-113, BLU-116, JASSM-1000, J-1000, and the JAST-1000.

Although in the illustrated example, the reactive fragments 10 in the explosive charge 70 are randomly combined within the warhead 50, it should be recognized at the reactive fragments 10 and the explosive charge 70 can be arranged in different ways. For example, reactive fragments and an explosive charge may be separated or segregated, and may have spacers or buffers placed between them. Such an arrangement may be advantageous when it is desired to lessen the sensitivity of the reactive fragments. That is, upon impact of the warhead 50 with an appropriate target, the energy imparted to the reactive fragments is delayed via the above noted physical separation and/or spacers or buffers. Thus, the chemical energy released upon activation of the reactive fragments can also be delayed, which may be desirable to maximize the destructive effects of the warhead upon a particular target or groups of targets.

Figure 5:
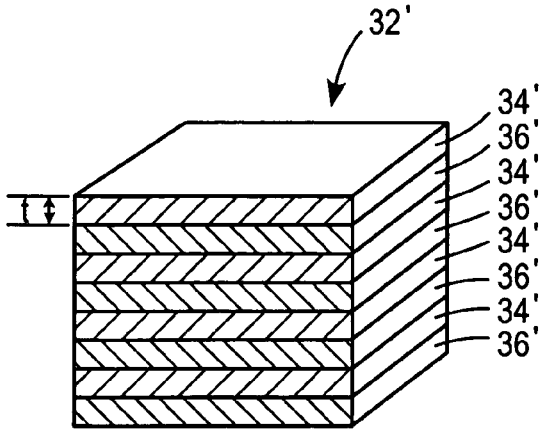
FIG. 5 is a schematic cross-section of a thin-film reactive material formed according to an alternative embodiment of the present invention.

One advantage of a reactive fragment formed according to principles of the present invention is that both the composition and/or morphology of the reactive material 30 can be used to tailor the sensitivity of the reactive fragment to impact forces. While the total chemical energy content of the reactive material is primarily a function of the quantity of the reducing metal and metal oxide constituents, the rate at which that energy is released is a function of the arrangement of the reducing metal and metal oxide relative to one another. For instance, the greater the degree of mixing between the reducing metal and metal oxide components of the energetic material, the quicker the reaction that releases thermal energy will proceed. Consider the embodiment of the thin-film 32' depicted in FIG. 5 compared with the embodiment of the thin-film 32 depicted in FIG. 4. The layers of reducing metal 34' and metal oxide 36' contained in the thin-film 32' have a thickness t which is less than that of the thickness T of the layers in thin-film 32 (T>t). Otherwise, the volume of the thin films 32 and 32' are the same. Thus, the total mass of reducing metal and the total mass of metal oxide contained in the two thin films are likewise the same. As a result, the total thermal energy released by the two films should be approximately the same. However, it is evident that the reducing metal and metal oxide are intermixed to a greater degree in the thin-film 32'. The thermal energy released by the thin-film 32' will proceed at a faster rate than the release of thermal energy from the thin-film 32. Thus, the timing of the release of thermal energy from a thin-film formed according to the principles of the present invention can be controlled to a certain extent by altering the thickness of the layers of reducing metal and metal oxide contained therein.

Similarly, the timing of the release of chemical energy from a thin-film formed according to the principles of the present invention can also be controlled, at least to some degree, by the selection of materials, and their location, within a thin-film. For example, in the thin-film 32' depicted in FIG. 5, the rate at which thermal energy is released can be altered by placing layers of metal oxide and/or reducing metal which have a greater reactivity toward the interior of the thin film 32', while positioning reducing metal and four/or metal oxide layers having a lower reactivity on the periphery (i.e. top and bottom). Since those layers located on the periphery of the thin-film 32' are presumably more susceptible to ignition due to their proximity to outside forces, these layers will begin to release thermal energy prior to those layers contained on the interior. By placing less reactive materials on the periphery, the overall reaction rate of the thin-film 32 can be slowed.

Figure 6:
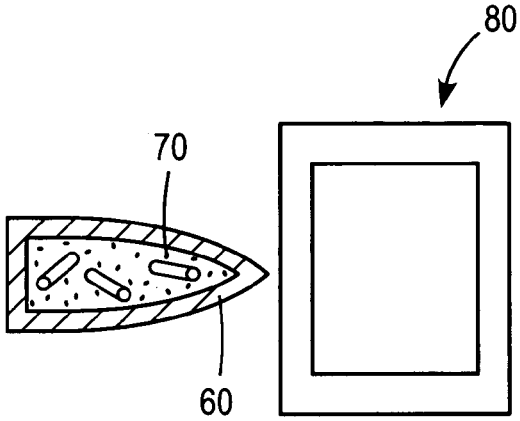
FIG. 6 is a schematic illustration of a mode of operation of an embodiment of the present invention, at a first stage.
Figure 7:
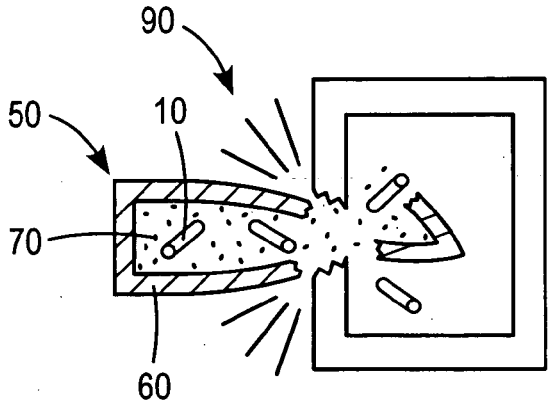
FIG. 7 is a schematic illustration of a mode of operation of an embodiment of the present invention, at a second stage.
Figure 8:
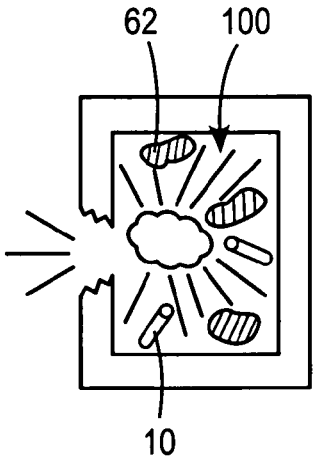
FIG. 8 is a schematic illustration of a mode of operation of an embodiment of the present invention, at a third stage.

The ability to tailor the rate of release of thermal energy from a reactive fragment can be advantageous in the design of certain munitions. For example, in the case of a penetrating warhead containing reactive fragments, it can be desirable to maximize the release of energy from the warhead after the target has been penetrated, thereby maximizing the destructive effects of the warhead. This behavior is schematically illustrated in FIGS. 6-8 as illustrated in FIG. 6, a warhead 50 containing reactive fragments 10 and an explosive charge 70 approaches a target 80. Upon collision (FIG. 7), the warhead 50 begins to penetrate the target 80 and an initial release of kinetic and thermal energy 90 occurs, primarily due to the kinetic impact of the warhead casing 60 and the initial release of thermal energy, mainly from the explosive charge 70. At this stage, the kinetic and thermal effects of the fragments on the target 90 are minimal. At a later stage, depicted in FIG. 8, the target has been fully penetrated and a subsequent release of kinetic and thermal energy is imparted to the target 80. As illustrated in FIG. 8, the casing 60 has broken apart releasing casing fragments 62 which kinetically impact the target 90. The fragments 10 also kinetically impact the target. At this point, a subsequent release of thermal energy also occurs, which is a combination of thermal energy released from the explosive charge 70, as well as the release of thermal energy from the energetic material 30 contained in the reactive fragments 10, which has been intentionally delayed so as to occur within the interior region of the target, thereby maximizing the destructive capabilities of the warhead 50.

One alternative munition in which the reactive fragments (10) of the present invention may be utilized (not shown) comprises a warhead designed to detonate prior to impacting the target, the reactive fragments (10) are propelled into the target and can then release the chemical energy stored therein.

Another advantage provided by the present invention is the ability to design reactive fragments which can react at lower impact velocities, for example, at impact velocities on the order of 2,000 ft/sec. or less. This is an improvement over the existing technology because: (1) it permits reduced launch velocity thereby improving the survivability of the fragment; (2) extends the reactive envelope of the fragment by allowing the fragment to travel further before it lacks the kinetic energy to ignite; and (3) opens the system design space by potentially reducing the size of the warhead.

Other advantages provided by the present invention can be attributed to the use of a metallic binder material 20, of the type described herein, in the formation of a reactive fragment. First, the reactive fragment with the metallic binder possesses a greater density relative to other reactive fragments which are formed utilizing a polymeric binder material. This increased density enhances the ballistic effects of the fragment on the target by imparting more kinetic energy thereto. The metallic binder material also increases the structural integrity of the fragment thereby enhancing the same ballistic effects. This increased structural integrity also enhances the ability of the fragments to withstand the shock loadings encountered during firing of the munition within which the fragments may be contained.

Still other advantages can be attained from the reactive fragments of the present invention. During the blast, particles of the metallic binder material will likely exhibit a desirable nonideal gas-like behavior due to its high density, large molecular weight and heat transfer rates. Namely, momentum effects of the blast likely result in the particles of the metallic binder material lagging in velocity behind the lighter weight gas explosive products such as CO, $CO_2$, $N_2$, and $H_2O$ vapor. Similarly, heat transfer effects on the particles of the metallic binder material also lag behind. This desirable non-ideal behavior suggests that the sharpness of an overpressure peak during the initial blast will be somewhat attenuated due to thermal and kinetic energy storage of released binder particles. As the blast progresses, release of the kinetic and thermal energy stored by the particles of the metallic binder material will ideally result in an extension of the time at overpressure, thereby enhancing damage to the target (e.g., FIGS. 7-8). Many metallic binder materials, such as those discussed above, have relatively strong thermodynamic tendencies to react with oxygen in air. Thus, particles of metallic binder material may impart a significant afterburning component to the blast, further extending the overpressure in the time domain and the release of energy into the target. Any metallic binder material which is not consumed by afterburning can be readily distributed into the target as a result of a successful reactive fragment impact, thus increasing the likelihood of electrical short-circuiting if electrical components are housed within the target.

All numbers expressing quantities of ingredients, constituents, reaction conditions, and so forth used in the specification are to be understood as being modified in all instances by the term "about". Notwithstanding that the numerical ranges and parameters setting forth, the broad scope of the subject matter presented herein are approximations, the numerical values set forth are indicated as precisely as possible. Any numerical value, however, inherently contains certain errors necessarily resulting from the standard deviation found in their respective measurement techniques.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A munition comprising:

a reactive fragment comprising a plurality of discrete structures dispersed in a metallic binder material, and wherein each structure comprises an energetic material, the energetic material including a first material that is a reducing metal or metal hydride and a second material that is a metal oxide.

2. The munition of claim 1, wherein the reactive fragment is shaped as a cylinder or with a surface in the shape of a polygon.

3. The munition of claim 1, wherein the fragment comprises an outer periphery that is at least partially case-hardened or jacketed.

4. The munition of claim 1, wherein the metallic binder has a density of at least about 7.5 g/cm$^3$.

5. The munition of claim 1, wherein the metallic binder has a density of about 1.0 to about 17.0 g/cm$^3$.

6. The munition of claim 1, wherein the metallic binder material comprises one or more of bismuth, lead, tin, indium, and alloys thereof.

7. The munition of claim 1, wherein the discrete structures are in the form of flakes, powder, or crystals.

8. The munition of claim 1, wherein at least one of the discrete structures comprises a plurality of layers including at least one layer comprising a reducing metal or metal hydride and at least one adjacent layer comprising a metal oxide.

9. The munition of claim 8, wherein the layers have a thickness of about 10 to about 10000 nm.

10. The munition of claim 1, wherein the reactive fragment additionally comprises one or more of: an organic material, and inorganic material, a metastable intermolecular composite, or a hydride.

11. The munition of claim 1, wherein at least one of the plurality of discrete structures and the metallic binder material is surface treated to promote wetting.

12. The munition of claim 1, wherein the reactive fragment further comprises a reinforcing agent comprising one or more of fibers, filaments, dispersed particulates, and mixtures thereof.

13. The munition of claim 1, wherein the munition comprises a warhead, the warhead comprising a casing, and wherein the reactive fragment is disposed completely within the casing.

14. The munition of claim 13, further comprising a plurality of reactive fragments disposed completely within the casing.

15. The munition of claim 1, further comprising an explosive charge, wherein the munition is configured to allow release of thermal energy into a target from the reactive fragment after release of thermal energy from the explosive charge.

16. The munition of claim 15, wherein the explosive charge surrounds the reactive fragment.

17. The munition of claim 1, wherein the metallic binder material is an alloy of zinc.

* * * * *